US007182574B2

(12) United States Patent
Lyons

(10) Patent No.: US 7,182,574 B2
(45) Date of Patent: Feb. 27, 2007

(54) DRAFT INDUCER BLOWER WITH FASTENER RETENTION

(75) Inventor: Leslie A Lyons, Cassville, MO (US)

(73) Assignee: Fasco Industries, Inc., Eaton Rapids, MI (US)

( * ) Notice: Subject to any disclaimer, the term of this patent is extended or adjusted under 35 U.S.C. 154(b) by 146 days.

(21) Appl. No.: 10/982,454

(22) Filed: Nov. 5, 2004

(65) Prior Publication Data

US 2006/0099072 A1 May 11, 2006

(51) Int. Cl.
*F04D 29/60* (2006.01)

(52) U.S. Cl. ..... 415/213.1; 415/214.1; 411/999; 403/12

(58) Field of Classification Search ..... 403/12; 411/999; 415/213.1, 214.1, 215.1, 9
See application file for complete search history.

(56) References Cited

U.S. PATENT DOCUMENTS

| | | | | |
|---|---|---|---|---|
| D282,869 | S | 3/1986 | Parnell | D23/73 |
| D289,680 | S | 5/1987 | Heob | D23/127 |
| 5,290,132 | A * | 3/1994 | Gnage et al. | 411/999 |
| 5,954,476 | A | 9/1999 | Stewart et al. | 415/214.1 |
| 6,231,311 | B1 | 5/2001 | Gatley et al. | 417/53 |
| 6,314,894 | B1 | 11/2001 | Gatley, Jr. | 110/341 |
| 6,352,431 | B1 | 3/2002 | Gatley, Jr. | 432/77 |
| 6,353,303 | B1 | 3/2002 | Ramachandran et al. | 318/727 |
| 6,386,123 | B1 | 5/2002 | Gatley, Jr. | 110/162 |
| 6,435,818 | B1 | 8/2002 | Gatley, Jr. | 415/119 |
| 6,468,034 | B1 | 10/2002 | Garrison et al. | 415/212.1 |
| 6,494,152 | B2 | 12/2002 | Gatley, Jr. | 110/341 |
| 6,511,288 | B1 | 1/2003 | Gatley, Jr. | 415/206 |
| 6,511,290 | B1 | 1/2003 | Gatley, Jr. | 415/212.1 |
| 6,530,346 | B1 | 3/2003 | Coones et al. | 122/4 R |
| 6,553,923 | B2 * | 4/2003 | Gatley, Jr. | 415/206 |
| 6,575,696 | B1 | 6/2003 | Lyons et al. | 415/119 |
| 6,595,146 | B2 | 7/2003 | Gatley, Jr. | 110/162 |
| 6,602,058 | B1 | 8/2003 | Stewart | 417/366 |
| 6,622,660 | B1 | 9/2003 | Bajic et al. | 122/13.01 |

* cited by examiner

*Primary Examiner*—Richard A. Edgar
(74) *Attorney, Agent, or Firm*—Baker & Daniels LLP

(57) ABSTRACT

A draft inducer blower for high efficiency furnaces, including a blower housing having a housing body and housing cover. The housing body includes a plurality of mounting lugs spaced around its outer periphery, through which fasteners are inserted to secure the blower housing to corresponding mounting holes in a furnace wall. The mounting lugs each include a slot-like opening having a web of material therein and, in each mounting lug, a fastener is threaded through an opening in the web to temporarily retain the fastener in position within its associated mounting lug. In this manner, a blower housing may be shipped to a furnace manufacturer or other point of installation with the fasteners temporarily retained within their associated mounting lugs. During installation, after the mounting lugs of the blower housing are aligned with the mounting holes of the furnace wall, a suitable tool is used to thread the fasteners through the web of material in the mounting lugs and into the mounting holes to secure the blower housing to the furnace wall.

14 Claims, 7 Drawing Sheets

DRAFT INDUCER BLOWER WITH FASTENER RETENTION

BACKGROUND OF THE INVENTION

1. Field of the Invention

The present invention relates to air moving devices, and in particular, to blowers of the type which are used with high efficiency (e.g., 90% or higher efficiency) furnaces for drawing air from outside of a building into the furnace to support combustion and to expel combustion exhaust products outside of a building. More particularly, the present invention relates to the mounting lugs and fasteners of the blower housing which are used to mount the blower housing to a furnace.

2. Description of the Related Art

In high efficiency furnaces, standard chimney air-draw effects are not sufficient to assure the required air flow through the furnace heat exchangers, and therefore, high efficiency furnaces utilize draft inducer blowers to provide sufficient air flow through the furnace. In particular, the blowers of high efficiency furnaces pull flue gases through the furnace heat exchangers and then push the flue gases outwardly through exhaust piping to the exterior of the building.

Existing furnaces include a wall or collector box having a standard arrangement of mounting holes which are configured in a generally circular pattern about an exhaust opening in the wall. A blower housing is attached to the wall using a plurality of fasteners, typically threaded bolts or screws, which are inserted through mounting lugs in the blower housing and into the mounting holes in the furnace wall. Typically, the mounting lugs of the blower housing include slot-like openings through which the fasteners are inserted, wherein the elongated, slot-like shape of the openings permit a limited amount of adjustment with respect to the positioning of the fasteners.

A problem with this arrangement is that during mounting of the blower housing to the furnace wall in the factory or in the field, it is necessary for the installer to initially align the mounting lugs of the blower housing with the mounting holes in the furnace wall and, while maintaining the aligned position of the blower housing, manually locate and insert the fasteners one by one through the openings in the mounting lugs followed by threading each fasteners into its corresponding mounting hole using a suitable tool. This process, which requires manual insertion of the fasteners through the mounting lugs, typically slows the speed of mounting the blower housing to a furnace wall.

What is needed is an apparatus and method which permits the blower housing of a furnace blower to be installed to the wall of a furnace in a more efficient manner.

SUMMARY OF THE INVENTION

The present invention provides a draft inducer blower for high efficiency furnaces, including a blower housing having a housing body and housing cover. The housing body includes a plurality of mounting lugs spaced around its outer periphery, through which fasteners are inserted to secure the blower housing to corresponding mounting holes in a furnace wall. The mounting lugs each include a slot-like opening having a web of material therein and, in each mounting lug, a fastener is threaded through an opening in the web to temporarily retain the fastener in position within its associated mounting lug. In this manner, a blower housing may be shipped to a furnace manufacturer or other point of installation with the fasteners temporarily retained within their associated mounting lugs. During installation, after the mounting lugs of the blower housing are aligned with the mounting holes of the furnace wall, a suitable tool is used to thread the fasteners through the web of material in the mounting lugs and into the mounting holes to secure the blower housing to the furnace wall.

Advantageously, the blower housing of the present invention includes mounting lugs having fasteners temporarily retained therein, thereby enabling the blower housing and fasteners to be shipped as a single component. This construction obviates the need to ship the fasteners separately, and eliminates the installation step of manually locating and inserting the fasteners through the openings of the mounting lugs. According to the present method, to secure the blower housing to the wall of a furnace, the installer need only align the mounting lugs of the blower housing with the mounting holes of the furnace wall, and then thread the fasteners into the mounting holes.

During installation, the web of material within each mounting lug, which temporarily retains the fasteners therein, may bend, deform, or break as necessary to allow the fasteners to be completely inserted through the mounting lugs and into the mounting holes of the furnace. Additionally, the webs are also bendable, deformable, or breakable to allow for variations in the angular orientation of the fasteners as necessary to align same with the mounting holes in the furnace wall.

In one form thereof, the present invention provides a blower housing, including a first housing member having an outer periphery; a plurality of mounting lugs disposed around the outer periphery of the first housing member, each mounting lug including a fastener temporarily retained therein.

In another form thereof, the present invention provides a blower housing, including a first housing member having a generally circular outer periphery; a plurality of mounting lugs disposed about the outer periphery of the first housing member, each mounting lug including an opening; at least one web extending at least partially across the opening, the at least one web configured to retain a fastener; and a fastener disposed within the passage and retained within the hole.

In a further form thereof, the present invention provides a method of mounting a blower housing to a furnace wall having mounting holes, including the steps of providing a blower housing including a plurality of mounting lugs having respective fasteners temporarily retained therein; positioning the blower housing against the furnace wall with the mounting lugs in respective alignment with the mounting holes; engaging the fasteners with respective mounting holes to attach the blower housing to the furnace wall.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
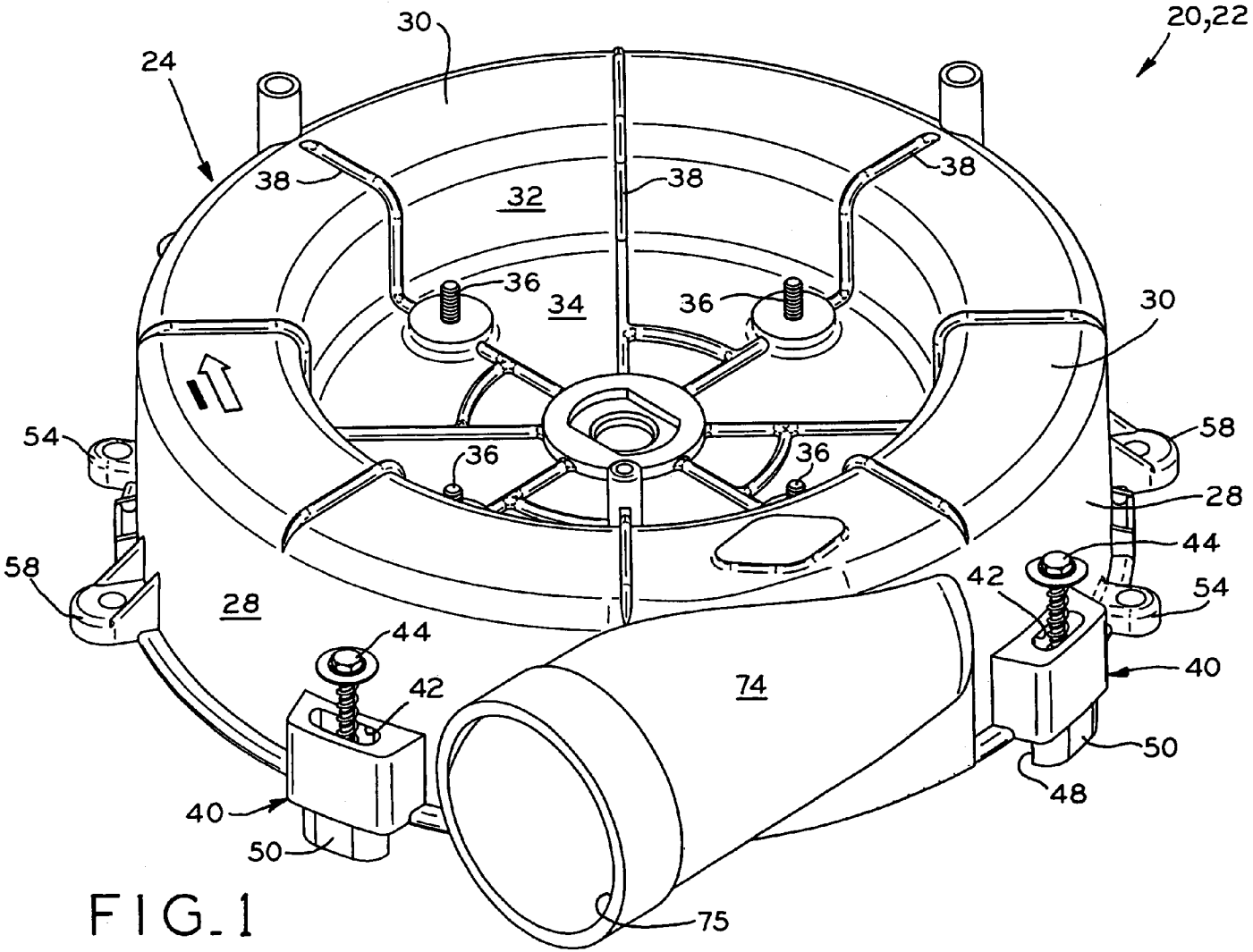
FIG. 1 is a perspective view of a blower housing including a plurality of mounting lugs having a fastener retention feature in accordance with the present invention.
Figure 2:
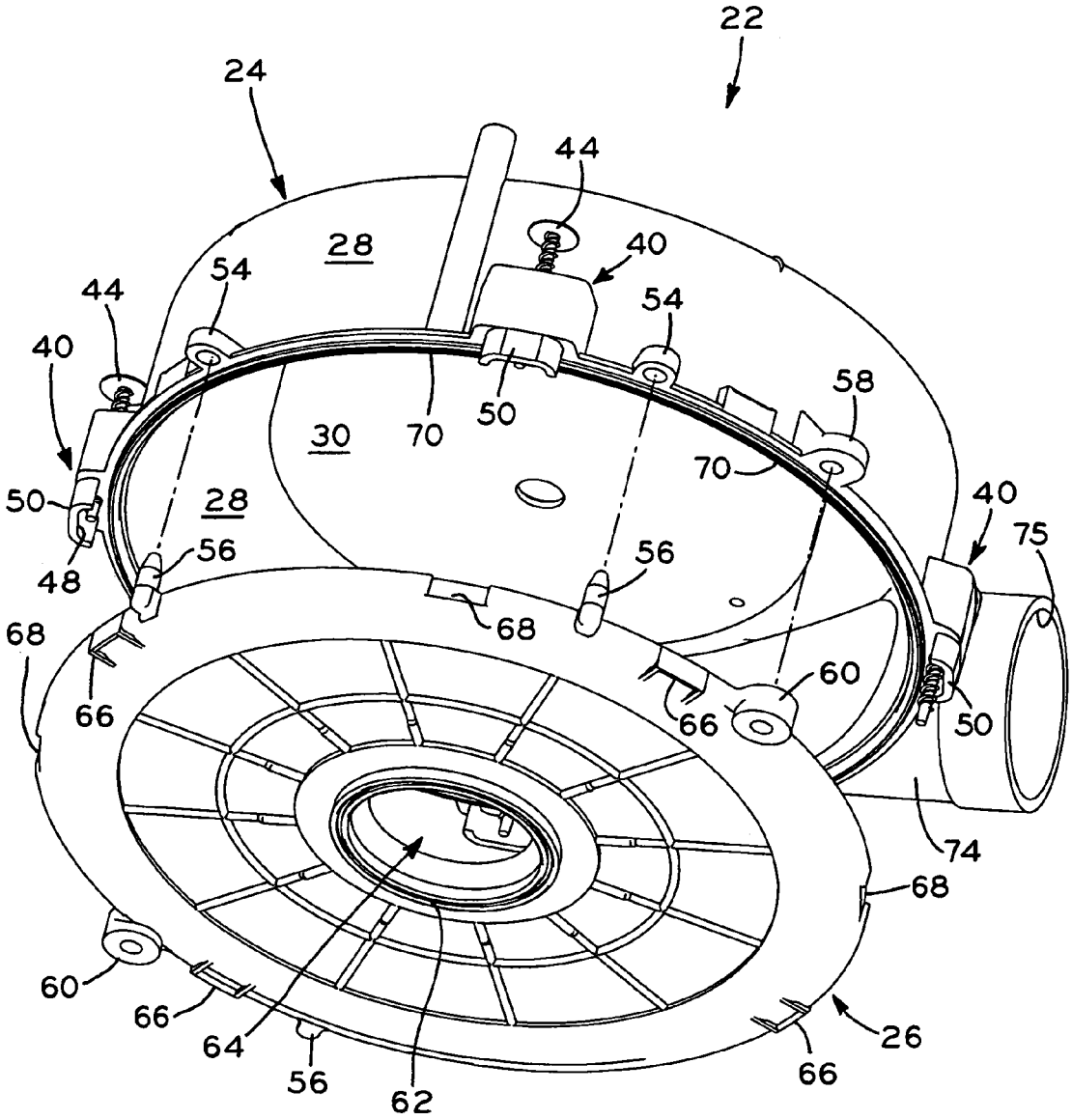
FIG. 2 is an exploded view of the blower housing of FIG. 1, viewed from below, showing the housing cover exploded away from the housing body.
Figure 3:
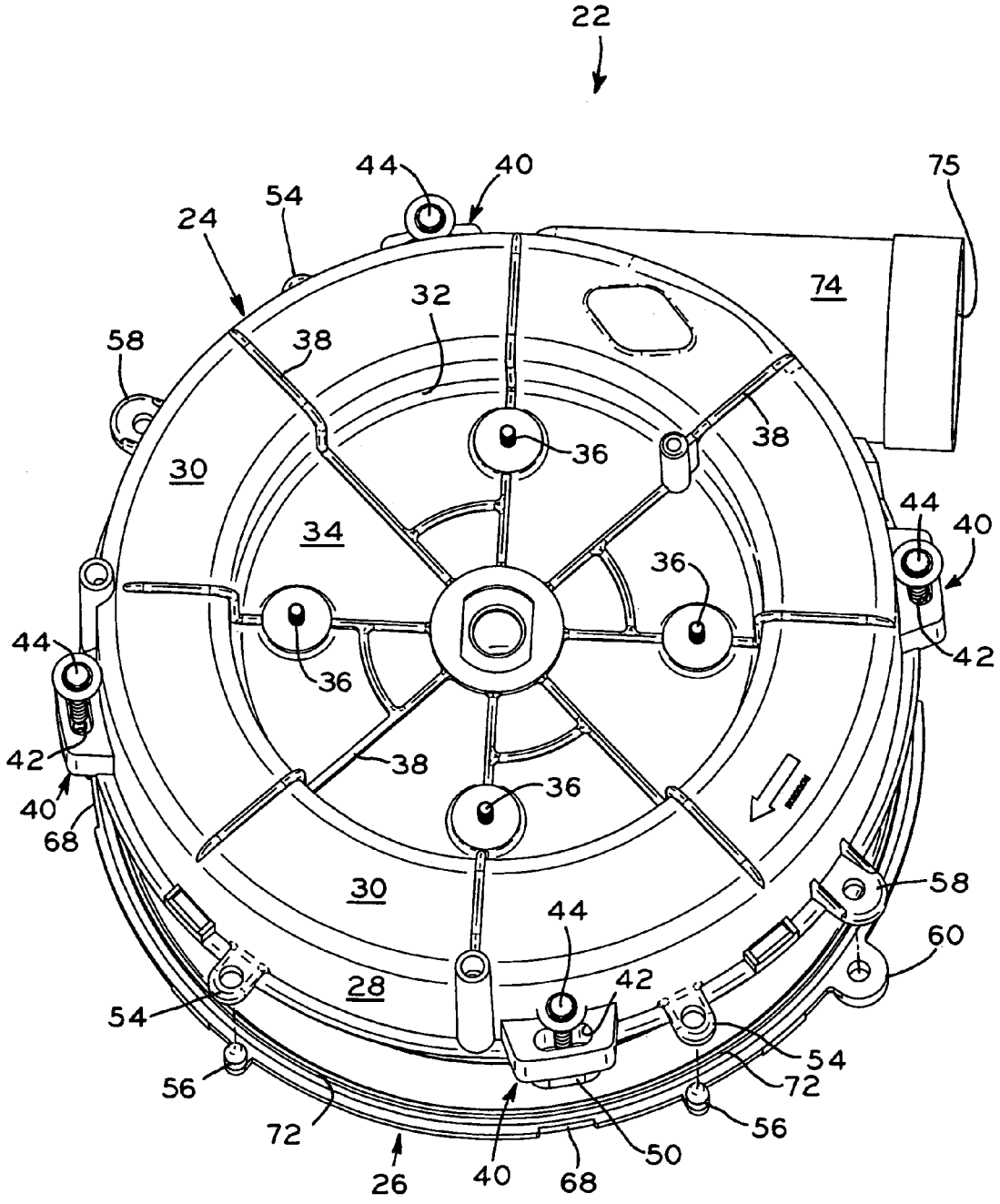
FIG. 3 is an further exploded view of the blower housing of FIG. 1, viewed from above, showing the housing cover exploded away from the housing body.

Referring first to FIGS. 1–3, a blower 20 for a high efficiency furnace is shown, according to the present invention. Blower 20 generally includes blower housing 22, and also includes an electric motor (not shown) mounted to blower housing 22, and an impeller (not shown) mounted to the output shaft of the motor and disposed within blower housing 22. In operation, rotation of the impeller by the motor draws air from a furnace through the inlet of blower housing 22 and exhausts the air through the outlet of blower housing 22.

Blower housing 22 generally includes a first housing member or housing body 24, and a second housing member or housing cover 26 (FIGS. 2 and 3). Housing body 24 and housing cover 26 may be formed of stamped or formed metal, or may be formed of plastic via an injection molding process, for example. Suitable plastics for housing body 24 and housing cover 26 include polypropylene or other thermoplastics. Housing body 24 includes a generally cylindrical outer wall 28, an annular top wall 30, an inner wall 32, and a recessed wall 34. The motor of blower 20 is attached to recessed wall 34 of blower housing by a plurality of fasteners 36. Housing body 24 additionally includes a plurality of reinforcement ridges 38 extending along top wall 30, inner wall 32, and recessed wall 34 for providing structural strength and rigidity to housing cover 24.

Figure 7:
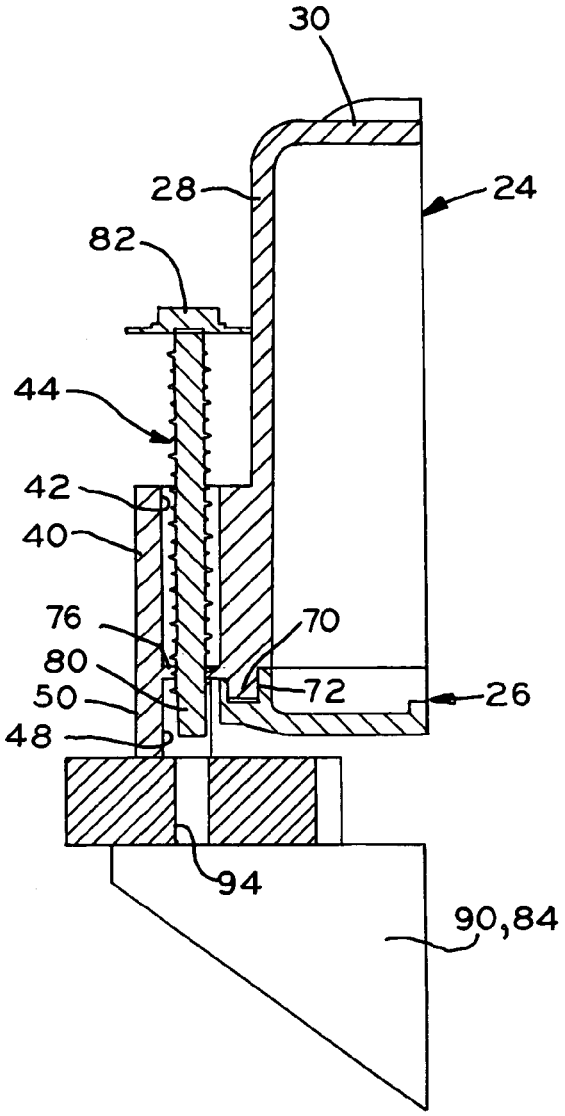
FIG. 7 is a sectional view taken along line 7—7 of FIG. 6, showing the positioning of the blower housing with respect to a mounting flange of the collector box prior to insertion of a fastener into a mounting hole of the mounting flange.
Figure 8:
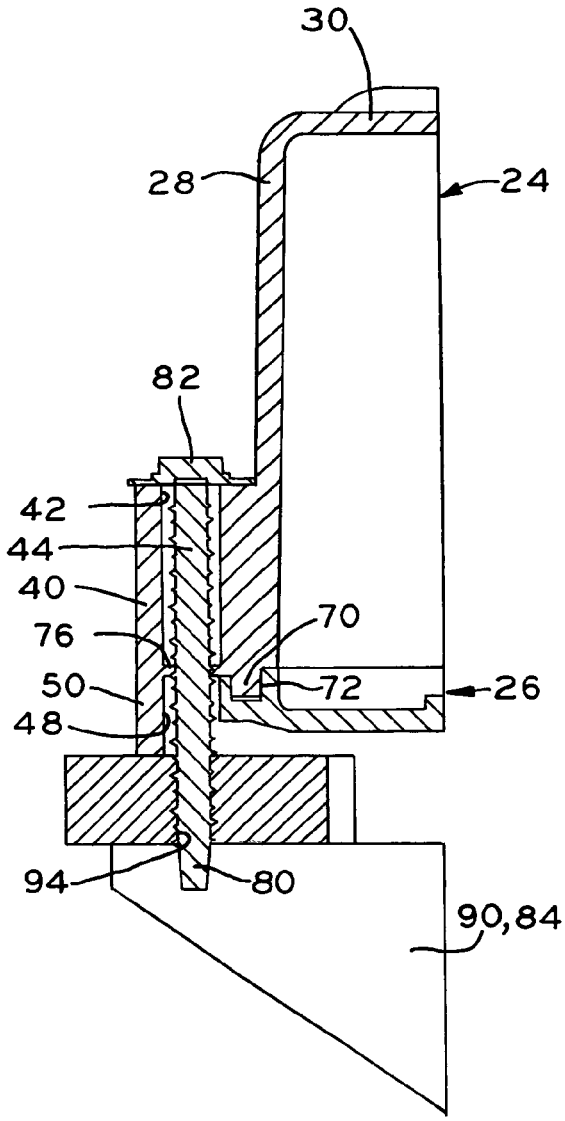
FIG. 8 is another sectional view taken along line 7—7 of FIG. 6, showing the blower housing secured to a mounting flange of the collector box with the fastener threaded into the mounting hole of the mounting flange.

Housing body 24 additionally includes a plurality of mounting lugs 40 integrally formed therewith, which are disposed radially outwardly of outer wall 28 and spaced around the outer periphery of blower housing 22. Alternatively, at least a portion of mounting lugs 40 may be integrally formed with housing cover 26. Mounting lugs 40 include slot-like or oval openings or passages 42 therethrough for receipt of fasteners 44 to attach blower housing 22 to the wall of a furnace in the manner described below. Alternatively, openings 42 of mounting lugs 40 may be circular in shape, or may be shaped in other shapes such as rectangular, for example. As shown in FIGS. 7 and 8 and described in further detail below, fasteners 44 extend downwardly through mounting lugs 40 of housing body 24, adjacent recesses 48 in lug feet 50 of housing cover body 24, and into mounting holes in a furnace wall to rigidly secure blower housing 22 to the wall of the furnace, with housing cover 26 captured between housing body 24 and the furnace wall.

Additionally, housing body 24 includes a plurality of locating lugs 54 integrally formed therewith, which are disposed radially outwardly of outer wall 28 and spaced around the periphery of housing cover 24. Locating lugs 54 include openings for receipt of upwardly-projecting locating pins 56 of housing cover 26 to thereby positively locate housing cover 26 with respect to housing body 24. Optionally, housing body 24 includes one or more auxiliary attachment lugs 58 for receipt of fasteners (not shown) which pass therethrough and also through one or more corresponding optional attachment lugs 60 of housing cover 26 to secure blower housing 22 to furnaces having an alternate furnace mounting bolt pattern.

As may be seen in FIGS. 2, 3 and 6–8, housing cover 26 cooperates with housing body 24 to define an enclosed, circular main cavity therebetween. Referring to FIG. 2, housing cover 26 includes a centrally disposed inwardly-projecting circular lip 62 defining a circular inlet opening 64. Housing cover 26 also includes a plurality of lug feet 66, as well as a plurality of recesses 68 which align with the recesses 48 of lug feet 50 of mounting lugs 40. Lug feet 66 of housing cover 26 and lug feet 50 mounting lugs 40 of housing body 24 each support blower housing 22 on the wall of a furnace with a slight air gap provided between housing cover 26 and the furnace wall. Optionally, a gasket (not shown) may be provided between housing cover 26 and the furnace wall to provide an air seal therebetween.

Referring to FIGS. 2, 3, 7, and 8, housing body 24 includes a downwardly-projecting tongue 70 disposed about the periphery thereof, which is received within a corresponding groove 72 about the periphery of housing cover 26 in a snap-fit manner to thereby secure housing cover 26 to housing body 24. Further details regarding the snap-fit attachment of housing cover 26 to housing body 24 are described in detail in U.S. Pat. No. 5,954,476 to Stewart et al., assigned to the assignee of the present invention, the disclosure of which is expressly incorporated herein by reference. Alternatively, housing body 24 may include groove 72, and housing cover 26 may include tongue 70. Optionally, a gasket or other seal (not shown) formed of a suitable resilient material, such as rubber or EPDM foam cording, for example, may be fitted between tongue 70 and groove 72 to enhance the seal therebetween. Lug feet 66 of housing cover 26 contact the wall of the furnace to maintain axial pressure on the snap-fit joint line between tongue 70 of housing body 24 and groove 72 of housing cover 26.

As shown in FIGS. 1–3, housing body 24 includes an integral exhaust transition 74 extending tangentially therefrom, which terminates in a circular exhaust outlet 75 to which an exhaust pipe or other duct structure (not shown) may be attached in a suitable manner, such as with clamps or other fasteners. Housing cover 24 may also include a contoured lobe (not shown) which fits with a secondary, curved joint line between housing body 24 and housing cover 26 along exhaust transition 74 in the manner described in detail in co-pending U.S. patent application Ser. No. 10/934,070, entitled LOBED JOINT DRAFT INDUCER BLOWER, filed on Sep. 3, 2004, assigned to the assignee of the present invention, the disclosure of which is expressly incorporated herein by reference. Additionally, outer wall 28, top wall 30, and inner wall 32 of housing body 24 may cooperate to define a volute of housing body 24 which extends around the circumference and outer periphery of blower housing 22 and increases in cross-sectional area from the cutoff area of blower housing 22 to exhaust transition 72 of housing body 24, as described in further detail in co-pending U.S. patent application Ser. No. 10/934,004, entitled DRAFT INDUCER BLOWER WITH Z-AXIS VOLUTE, filed on Sep. 3, 2004, assigned to the assignee of the present invention, the disclosure of which is expressly incorporated herein by reference.

Figure 4:
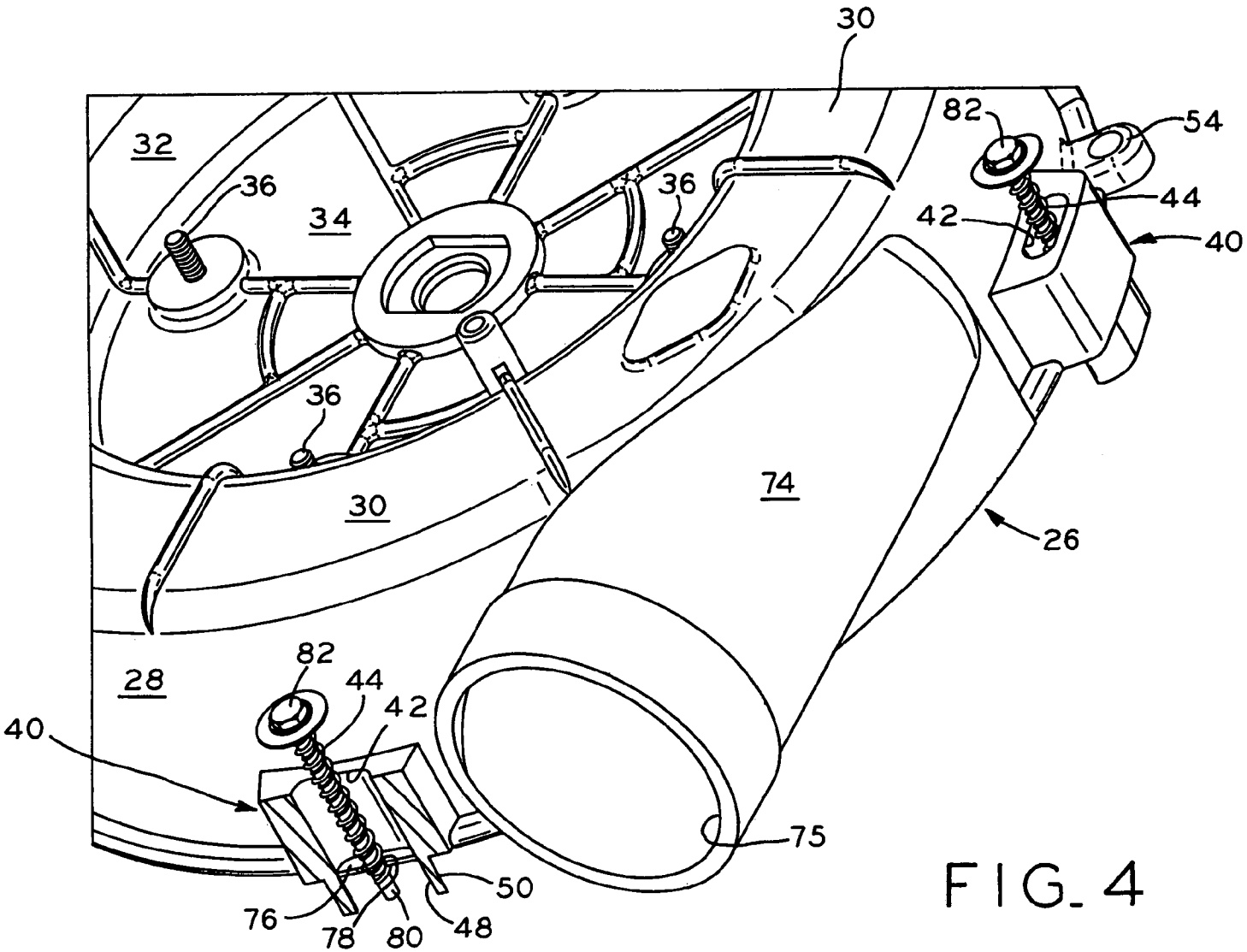
FIG. 4 is a perspective view of a portion of the blower housing of FIG. 1, with a portion of one of the mounting lugs thereof cut away.
Figure 5:
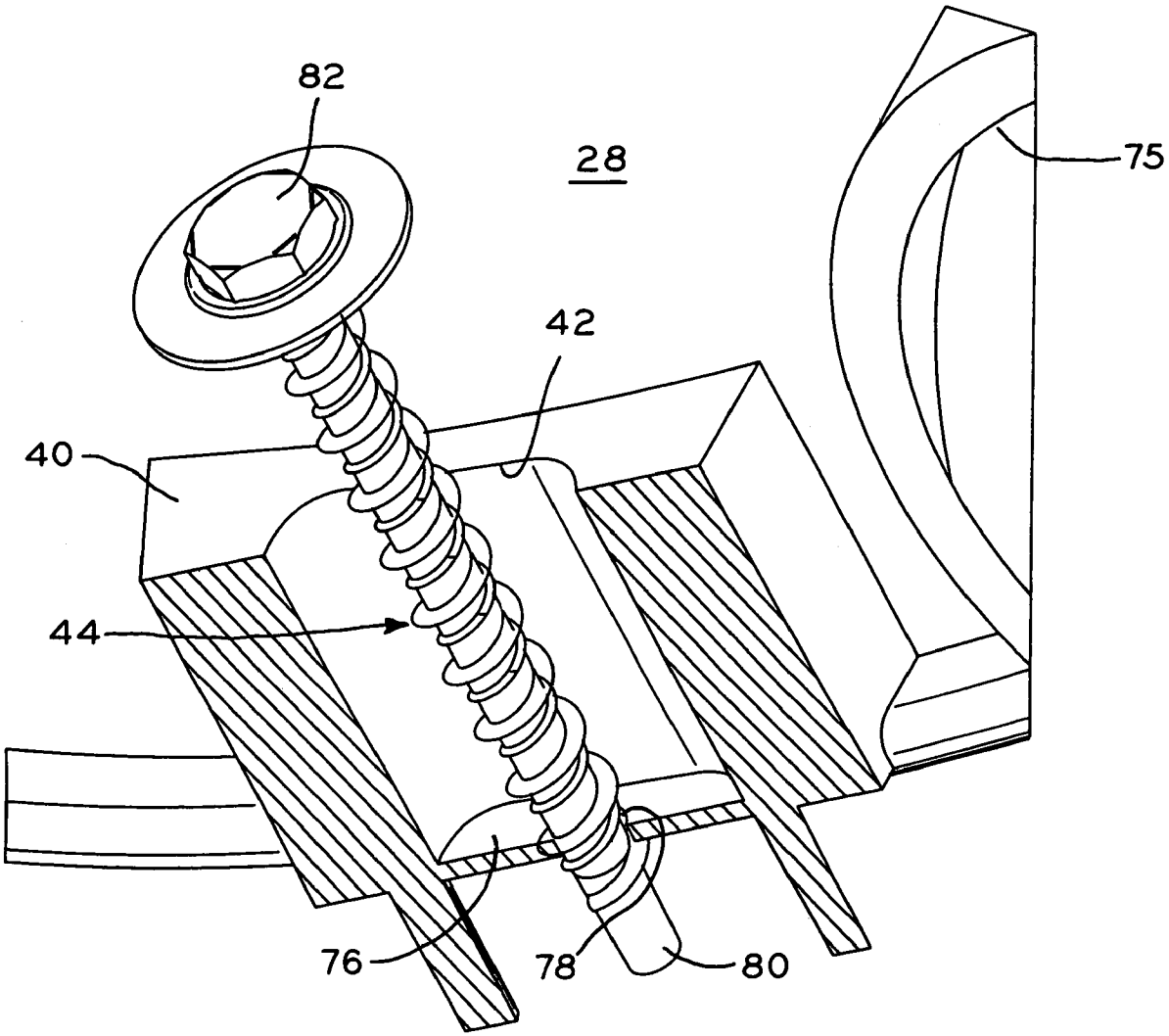
FIG. 5 is a closer perspective view of the mounting lug of the blower housing of FIG. 3, showing a fastener retained by a web within the mounting lug opening.

Referring to FIGS. 4, 5 and 6–8, a feature for temporarily retaining fasteners 44 within mounting lugs 40, and a method of mounting blower housing 22 to a furnace according to the present invention will now be described. Referring to FIGS. 4 and 5, openings 42 of mounting lugs 40 each include a web 76 of material therein, which may be integrally formed with mounting lugs 40, or may be a separate component otherwise secured to mounting lugs 40. In particular, when housing body 24 is made of an injection-molded plastic material, for example, webs 76 may be configured as relatively thin portions of plastic material integrally molded within mounting lugs 40. Webs 76 may extend completely across each opening 42, or may extend only partially across each opening 42. Webs 76 each include a hole 78 therein through which a fastener 44 is threaded. Alternatively, each opening 42 may include a pair of webs 76 defining a slot or gap therebetween which is configured to retain a fastener 44.

In one embodiment, shown in FIGS. 4 and 5, fasteners 44 may be inserted through openings 40 in mounting lugs 40 and threaded through holes 78 in webs 76 such that 3 or 4 turns of the threads of fasteners 44, for example, are threaded through holes 78. In this manner, lower ends 80 of fasteners 44 do not project further downwardly from housing body 24 than do lug feet 50 of mounting lugs 40. Upper ends 82 of fasteners 44 project from the top of mounting lugs 40, and include a hex nut or other suitable structure for engagement by a tool, such as a socket tool or a screwdriver, for example. In the foregoing manner, fasteners 44 are temporarily retained within mounting lugs 40.

Advantageously, as discussed below, the temporary retention of fasteners 44 within mounting lugs 40 allows each blower housing 22, including housing body 24 and cover 26, along with its associated fasteners 44, to be assembled, packaged, and shipped as a single unit. For example, housing cover 26 may be attached to housing body 24 via the snap-fit engagement between tongue 70 and groove 72, followed by threading fasteners 44 into holes 78 of webs 76 of mounting lugs 40 as described above. Each blower housing 22, including its fasteners 44, may be shipped as a single unit from the manufacturer of blower housing 22 to the manufacturer of a furnace for installation, or from the manufacturer of blower housing 22 to a location in the field for installation of blower housing 22 to a furnace. Alternatively, fasteners 44 may be assembled to mounting lugs 40 of housing body 24, and one or more housing bodies 24 and housing covers 26 may be shipped separately.

Figure 6:
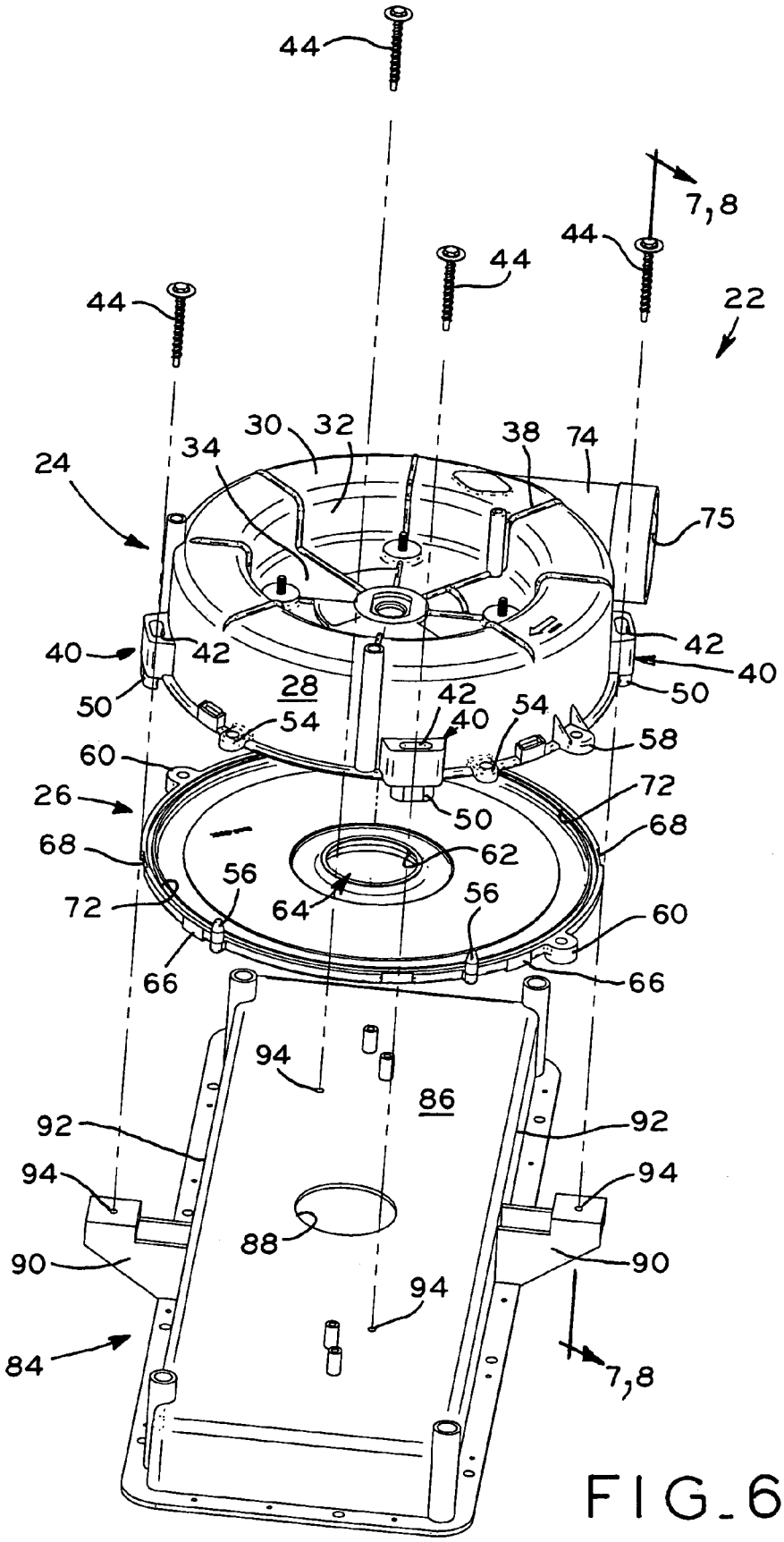
FIG. 6 is an exploded view showing the housing body and housing cover of the blower housing exploded away from a furnace collector box.

Referring to FIGS. 6–8, an exemplary manner by which blower housing 22 may be secured to the wall of a furnace is shown. In FIG. 6, fasteners 44 are shown exploded away from mounting lugs 40 of housing body 24 for clarity, however, during mounting of blower housing 22 to a furnace wall, fasteners 44 would be temporarily retained within mounting lugs 40 of housing body 24 in the manner described above. The furnace may include a collector box 84, shown in FIGS. 5 and 6 as a stamped or formed metal component, for example, which is attached to the wall of the furnace. Typically, collector box 84 is made of a corrosion-resistant stainless steel, but also may be made from a suitable engineered plastic resin, for example. Collector box 84 generally includes top wall 86 having exhaust opening 88, and a pair of mounting flanges 90 extending from side walls 92 of collector box 84. Mounting flanges 90 and top wall 86 each include mounting holes 94 which are typically arranged in a circular pattern having a standard diameter.

To mount blower housing 22 to collector box 84, blower housing 22 is positioned on collector box 84 such that exhaust opening 88 of collector box 84 is in alignment with inlet opening 64 of housing cover 26, and mounting lugs 40 are respectively aligned with corresponding mounting holes 94 in top wall 86 and mounting flanges 90 of collector box 84. In this position, lug feet 50 of mounting lugs 40 are in abutment with top wall 86 of collector box 84, or as shown in FIG. 7, lug feet 50 of mounting lugs 40 are in abutment with mounting flanges 90 of collector box 84. Additionally, although not shown in FIG. 7, lug feet 66 of housing cover 26 are also in abutment with top wall 86 and/or mounting flanges 90 of collector box 84. Lower ends 80 of fasteners 44 are disposed slightly upwardly of the lower ends of lug feet 50 of mounting lugs 40.

Thereafter, fasteners 44 are threaded downwardly with a suitable tool through webs 76 of mounting lugs 40 and into mounting holes 94 of collector box 84 to secure blower housing 22 thereto, as shown in FIG. 8. For example, an electric drill having a socket head attachment may be used to thread fasteners 44 into mounting holes 84. Although the attachment of blower housing 22 to collector box 84 of a furnace is described herein, blower housing 22 may be attached to a wall of a furnace which does not include collector box 84.

During the threading of fasteners 44 into mounting holes 94, webs 76 may bend, deform, or break as necessary as fasteners 44 are threaded therethrough into mounting holes 94. Additionally, webs 76 may also bend, deform, or break as necessary to allow for variations in the angular orientation of fasteners 44 to align same with mounting holes 94. For example, although fasteners 44 are shown generally vertically disposed in FIGS. 7 and 8, fasteners 44 may also be aligned at an angle with respect to vertical in order to properly align and thread same into mounting holes 94. The variation in the angular orientation of fasteners 44 is facilitated by the elongated slot-like profile of openings 42 in mounting lugs 40, as well as by the relatively thin profile of webs 76.

Although the exemplary collector box 84 is shown with mounting flanges 90, other collector boxes to which blower housing 22 may be mounted may include a top wall which lacks mounting flanges and is wider than that of blower housing 22. With these types of collector boxes, housing body 24 of blower housing 22 may be mounted directly to the top wall of the collector box with fasteners 44 in the manner described above, such that housing cover 26 is unnecessary.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blower housing, comprising:

a first housing member having an outer periphery;

a plurality of mounting lugs disposed around said outer periphery of said first housing member, each mounting lug further comprising:

an opening having an upper portion and a lower portion;

a web extending across said lower portion of said opening, said web including a hole; and a threaded fastener temporarily retained within said opening by threading at least a portion of said fastener through said hole of said web.

2. The blower housing of claim 1, wherein said web is relatively thin in comparison with said mounting lug.

3. The blower housing of claim 1, further comprising a second housing member attached to said first housing member.

4. The blower housing of claim 1, wherein said openings are shaped as elongated slots.

5. The blower housing of claim 1, wherein said mounting lugs each include a lug foot projecting from said first housing component.

6. The blower housing of claim 5, wherein said lug foot of each said mounting lug projects further away from said mounting lug than does a respective said fastener.

7. A blower housing, comprising:

a first housing member having a generally circular outer periphery;

a plurality of mounting lugs disposed about said outer periphery of said first housing member, each mounting lug comprising:

an opening;

at least one web extending at least partially across said opening, said at least one web configured to retain a fastener; and a fastener disposed within said passage and retained within said opening, said fastener having a plurality of threads, said fastener partially threaded through said web such that said at least one web is disposed between adjacent threads of said fastener to capture said fastener in a fixed position within said opening.

8. The blower housing of claim 7, wherein each mounting lug includes a single said web, said web being relatively thin in comparison with said mounting lug.

9. The blower housing of claim 7, further comprising a second housing member attached to said first housing member.

10. The blower housing of claim 7, wherein said openings are shaped as elongated slots.

11. The blower housing of claim 7, wherein said mounting lugs each include a lug foot projecting from said first housing component.

12. The blower housing of claim 11, wherein said lug foot of each said mounting lug projects further away from said mounting lug than does a respective said fastener.

13. A method of mounting a blower housing to a furnace wall having mounting holes, comprising the steps of:

providing a blower housing including a plurality of mounting lugs each having an opening and a web extending across the opening with a threaded fastener temporarily retained therein by engagement of the fastener threads with the web;

positioning the blower housing against the furnace wall with the mounting lugs in respective alignment with the mounting holes;

threading the fasteners within respective mounting holes to attach the blower housing to the furnace wall by further threading of the fasteners through their respective webs and into the mounting holes.

14. The method of claim 13, wherein said blower housing includes an outer periphery, the mounting lugs disposed around the outer periphery.

* * * * *